US007654076B2

(12) United States Patent
Wills

(10) Patent No.: US 7,654,076 B2
(45) Date of Patent: Feb. 2, 2010

(54) SYSTEM FOR CONTROLLING ABSORBER REGENERATION

(75) Inventor: Joan M. Wills, Nashville, IN (US)

(73) Assignee: Cummins, Inc., Columbus, IN (US)

( * ) Notice: Subject to any disclaimer, the term of this patent is extended or adjusted under 35 U.S.C. 154(b) by 210 days.

(21) Appl. No.: 11/593,803

(22) Filed: Nov. 7, 2006

(65) Prior Publication Data

US 2008/0104942 A1 May 8, 2008

(51) Int. Cl.
*F01N 3/00* (2006.01)

(52) U.S. Cl. ..... 60/274; 60/276; 60/285; 60/295; 60/297; 123/300; 123/443; 123/481; 701/103

(58) Field of Classification Search ..... 60/274, 60/276, 285, 286, 295, 297; 123/300, 325, 123/443, 481; 701/103, 109
See application file for complete search history.

(56) References Cited

U.S. PATENT DOCUMENTS 4,222,236 A 9/1980 Hegedus et al.
5,473,887 A 12/1995 Takeshima et al.
5,529,048 A 6/1996 Kurihara et al.
5,531,203 A 7/1996 Komatsuda et al.
5,600,947 A 2/1997 Cullen
5,635,142 A 6/1997 Ichiki et al.
5,743,084 A 4/1998 Hepburn
5,778,666 A * 7/1998 Cullen et al. ..... 60/274
5,784,879 A 7/1998 Dohta et al.
5,832,722 A * 11/1998 Cullen et al. ..... 60/274
5,878,567 A 3/1999 Adamezyk, Jr. et al.
5,894,725 A 4/1999 Cullen et al.
5,915,359 A 6/1999 Meyer et al.
5,974,788 A * 11/1999 Hepburn et al. ..... 60/274
6,185,935 B1 2/2001 Dickers et al.
6,199,372 B1 3/2001 Wakamoto
6,199,373 B1 * 3/2001 Hepburn et al. ..... 60/274
6,202,406 B1 3/2001 Griffin et al.
6,205,773 B1 3/2001 Suzuki
6,212,884 B1 4/2001 Ohuchi et al.
6,216,449 B1 4/2001 Strehlau et al.
6,233,925 B1 * 5/2001 Hirota et al. ..... 60/285
6,244,046 B1 6/2001 Yamashita
6,266,957 B1 7/2001 Nozawa et al.
6,272,848 B1 8/2001 Okude et al.
6,308,515 B1 10/2001 Bidner et al.
6,311,482 B1 11/2001 Yamashita
6,318,075 B1 11/2001 Gunther et al.
6,327,847 B1 12/2001 Surnilla et al.
6,327,848 B1 12/2001 Poggio et al.
6,345,498 B2 2/2002 Yonekura et al.

(Continued)

*Primary Examiner*—Binh Q Tran
(74) *Attorney, Agent, or Firm*—Krieg DeVault LLP

(57) ABSTRACT

A system, method, and software for controlling regeneration and desulfurization of a $NO_x$ adsorber is disclosed. An electronic control unit is connected with an engine for selectively controlling operation of the engine between a rich operating mode and a lean operating mode. A $NO_x$ adsorber is in fluid communication with a flow of exhaust from the engine. A $NO_x$ adsorber manager module is executable by the electronic control unit to determine the need to operate in a de-$NO_x$ mode or a de-$SO_x$ mode. If the $NO_x$ adsorber manager module determines a need exists to operate in the de-$NO_x$ mode and the de-$SO_x$ mode at the same time, the $NO_x$ adsorber manager module executes the de-$SO_x$ mode.

17 Claims, 8 Drawing Sheets

U.S. PATENT DOCUMENTS 6,360,530 B1 3/2002 Robichaux et al.
6,370,868 B1 4/2002 Kolmanovsky et al.
6,374,597 B1 4/2002 Bidner et al.
6,389,802 B1 5/2002 Berger et al.
6,401,454 B2 6/2002 Takano et al.
6,408,620 B2 6/2002 Boegner et al.
6,422,003 B1 7/2002 Ament et al.
6,427,439 B1 8/2002 Xu et al.
6,434,928 B1 8/2002 Manaka
6,438,944 B1 8/2002 Bidner et al.
6,451,602 B1 9/2002 Popoff et al.
6,453,663 B1 9/2002 Orzel et al.
6,453,664 B2 9/2002 Ishii et al.
6,463,733 B1 10/2002 Asik et al.
6,467,259 B1 10/2002 Surnilla et al.
6,477,832 B1 11/2002 Surnilla et al.
6,481,199 B1 11/2002 Bidner et al.
6,487,849 B1 12/2002 Bidner et al.
6,487,850 B1 12/2002 Bidner et al.
6,490,858 B2 12/2002 Barrett et al.
6,490,860 B1 12/2002 Farmer et al.
6,497,092 B1 12/2002 Theis
6,502,387 B1 1/2003 Asik et al.
6,502,391 B1 1/2003 Hirota et al.
6,513,319 B2 2/2003 Nozawa et al.
6,513,322 B2 2/2003 Ohuchi et al.
6,531,099 B1 3/2003 Held
6,562,753 B2 5/2003 Miyoshi et al.
6,568,177 B1 5/2003 Surnilla
6,588,205 B1 7/2003 Kumagai et al.
6,594,990 B2 7/2003 Kuenstler et al.
6,615,577 B2 9/2003 Meyer et al.
6,644,021 B2 11/2003 Okada et al.
6,651,422 B1 11/2003 LeGare
6,688,101 B2 2/2004 Isobe et al.
6,766,642 B2 7/2004 Binder et al.
6,792,346 B2 9/2004 Takebayashi et al.
6,813,879 B2 11/2004 Watner et al.
6,813,882 B2 11/2004 Hepburn et al.
6,823,658 B2 11/2004 Kuroda et al.
6,823,664 B2 11/2004 Nakatani et al.
6,823,665 B2 11/2004 Hirota et al.
6,829,888 B2 12/2004 Kuenstler et al.
6,871,492 B2 3/2005 Huynh et al.
6,889,497 B2 5/2005 Schnaibel et al.
6,901,749 B2 6/2005 Hashimoto
6,941,748 B2 9/2005 Pott et al.
6,962,045 B2 * 11/2005 Kitahara et al. ..... 60/295
6,990,799 B2 1/2006 Bidner et al.
7,121,086 B2 10/2006 Nishii et al.
7,134,274 B2 11/2006 Asanuma
2001/0007191 A1 7/2001 Ohuchi et al.
2001/0010149 A1 8/2001 Ishii et al.
2001/0013223 A1 8/2001 Boegner et al.
2001/0032456 A1 10/2001 Yonekura et al.
2001/0035008 A1 11/2001 Nozawa et al.
2002/0056268 A1 5/2002 Isobe et al.
2002/0073696 A1 6/2002 Kuenstler et al.
2002/0141908 A1 10/2002 Miyoshi et al.
2002/0170287 A1 11/2002 Hirota et al.
2002/0178716 A1 12/2002 Hpeburn et al.
2002/0189235 A1 12/2002 Meyer et al.
2002/0189580 A1 12/2002 Surnilla et al.
2003/0000205 A1 1/2003 Lewis et al.
2003/0037541 A1 2/2003 Farmer et al.
2003/0056497 A1 3/2003 Kuenstler et al.
2003/0056499 A1 3/2003 Binder et al.
2003/0101713 A1 6/2003 Dalla Betta et al.
2003/0106306 A1 6/2003 Nakatani et al.
2003/0106307 A1 6/2003 Okada et al.
2003/0131591 A1 7/2003 Pott et al.
2003/0134425 A1 7/2003 Ceccarini et al.
2003/0177761 A1 9/2003 Wagner et al.
2003/0212484 A1 11/2003 Takebayashi et al.
2003/0213235 A1 11/2003 Kitahara et al.
2004/0003587 A1 1/2004 Sakai
2006/0137327 A1 6/2006 Shirakawa et al.

* cited by examiner

SYSTEM FOR CONTROLLING ABSORBER REGENERATION

BACKGROUND

The present invention relates generally to exhaust treatment for an internal combustion engine and more particularly, but not exclusively, to a method, system, and software utilized to perform desulfurization ("de-$SO_x$") to a $NO_x$ adsorber during a de-$SO_x$ mode or to perform $NO_x$ regeneration ("de-$NO_x$") to the $NO_x$ adsorber during a de-$NO_x$ mode.

The Environmental Protection Agency ("EPA") is working aggressively to reduce pollution from new, heavy-duty diesel trucks and buses by requiring them to meet tougher emission standards that will make new heavy-duty vehicles up to 95% cleaner than older vehicles. Emission filters in the exhaust gas systems of internal combustion engines are used to remove unburned soot particles from the exhaust gas and to convert harmful pollutants such as hydrocarbons ("HC"), carbon monoxide ("CO"), oxides of nitrogen ("$NO_x$"), and oxides of sulfur ("$SO_x$") into harmless gases.

Exhaust gas is passed through a catalytic converter that is typically located between the engine and the muffler. In operation, the exhaust gases pass over one or more large surface areas that may be coated with a particular type of catalyst. A catalyst is a material that causes a chemical reaction to proceed at a usually faster rate without becoming part of the reaction process. The catalyst is not changed during the reaction process but rather converts the harmful pollutants into substances or gases that are not harmful to the environment.

$NO_x$ storage catalyst units are used to purify exhaust gases of combustion engines. These $NO_x$ storage catalyst units, in addition to storing or trapping $NO_x$, also trap and store unwanted $SO_x$ in the form of sulfates. The adsorption of $SO_x$ in the converter reduces the storage capacity of the adsorber and the catalytically active surface area of the catalyst. As such, $NO_x$ storage catalyst units must be regenerated to remove both $NO_x$ and $SO_x$. The process of regenerating a $NO_x$ storage catalyst unit varies depending on whether operating in a de-$NO_x$ mode (in which $NO_x$ is converted and removed from the unit) or a de-$SO_x$ mode (in which the unit is ran through a de-$SO_x$ process). Accordingly, there is a need for methods and systems for controlling an engine to place a $NO_x$ adsorber through a de-$NO_x$ and de-$SO_x$ process.

SUMMARY

One embodiment according to the present invention discloses a unique engine management system for controlling a de-$NO_x$ and de-$SO_x$ process of an adsorber. Other embodiments include unique apparatuses, systems, devices, hardware, software, methods, and combinations of these for controlling a de-$NO_x$ and de-$SO_x$ process of an adsorber utilized to convert harmful pollutants formed as a byproduct of the combustion process in an internal combustion engine into non-harmful substances. Further embodiments, forms, objects, features, advantages, aspects, and benefits of the present invention shall become apparent from the following description and drawings.

DETAILED DESCRIPTION OF ILLUSTRATIVE EMBODIMENTS

Figure 1:
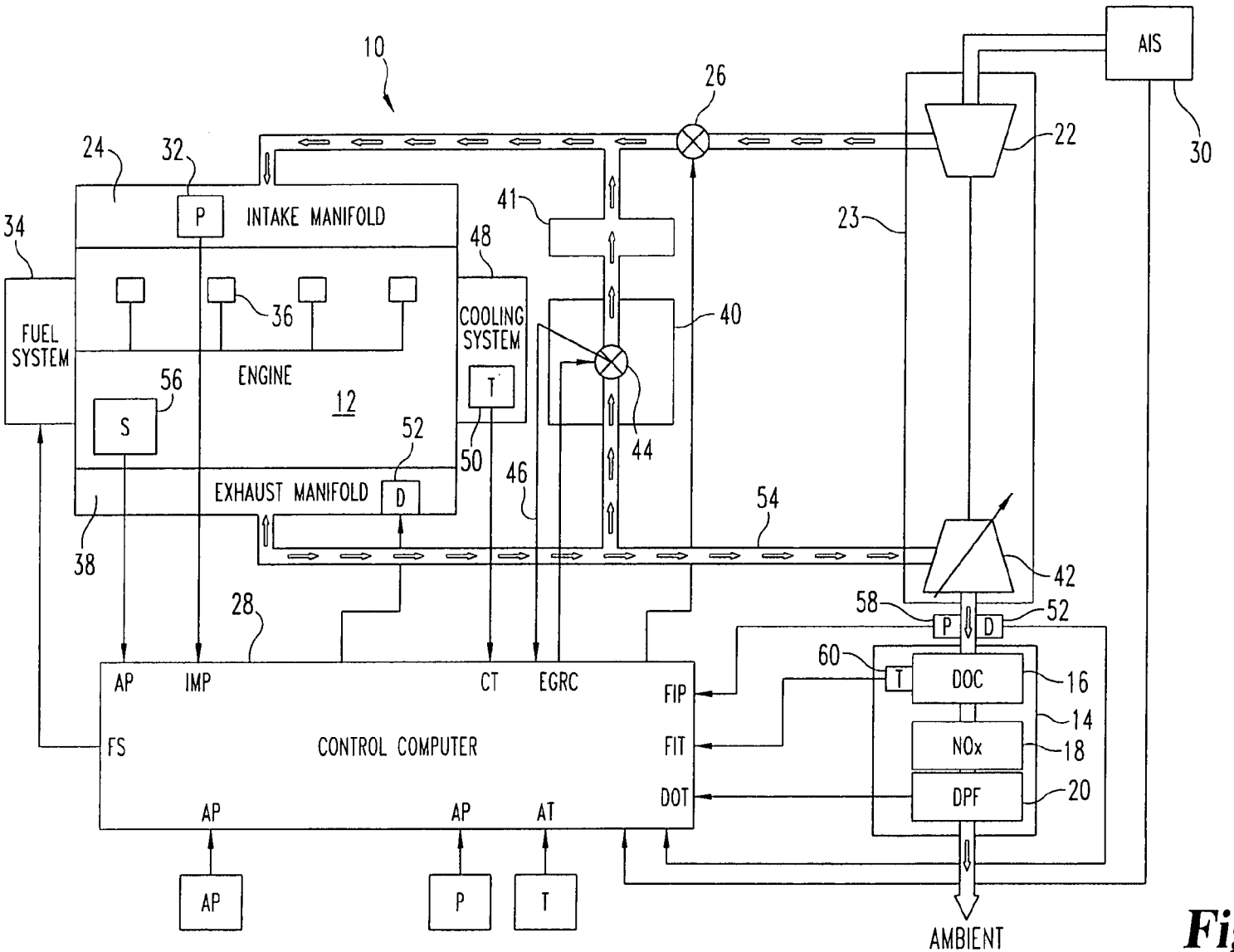
FIG. 1 is a schematic of a representative diesel engine system.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention is illustrated therein being contemplated as would normally occur to one skilled in the art to which the invention relates.

With reference to FIG. 1, there is illustrated, schematically, a system 10 that includes an internal combustion engine 12 operatively coupled with an exhaust filtration system 14. The exhaust filtration system 14 includes a diesel oxidation catalyst ("DOC") unit 16, a $NO_x$ adsorber or Lean $NO_x$ trap ("LNT") 18, and a diesel particulate filter ("DPF") 20. The exhaust filtration system 14 is operable to remove unwanted pollutants from exhaust gas exiting the engine 12 after the combustion process.

The DOC unit 16 is a flow through device that consists of a canister that may contain a honey-comb like structure or substrate. The substrate has a large surface area that is coated with an active catalyst layer. This layer may contain a small, well dispersed amount of precious metals such as, for example, platinum or palladium. As exhaust gas from the engine 12 traverses the catalyst, CO, gaseous HC and liquid HC particles (unburned fuel and oil) are oxidized, thereby reducing harmful emissions. The result of this process is that these pollutants are converted to carbon dioxide and water. In order to function properly, the DOC unit 16 must be heated to a minimum temperature value.

The $NO_x$ adsorber 18 is operable to absorb $NO_x$ created during the combustion process of the engine 12, thereby dramatically reducing the amount of $NO_x$ released into the atmosphere. The $NO_x$ adsorber 18 contains a catalyst that allows $NO_x$ to adsorb onto the catalyst. The process of adsorption releases carbon dioxide ("$CO_2$"). A byproduct of running the engine 12 in a lean mode is the production of harmful $NO_x$. The $NO_x$ adsorber 18 stores or absorbs $NO_x$ under lean engine operating conditions (lambda>1) and releases and catalytically reduces the stored $NO_x$ under rich engine operating conditions (lambda<1).

Under $NO_x$ regeneration, when the engine is operating under a rich condition at a predetermined temperature range, a catalytic reaction occurs. The stored $NO_x$ is catalytically converted to nitrogen ("$N_2$") and released from the $NO_x$ adsorber 18 thereby regenerating the $NO_x$ adsorber 18. The $NO_x$ adsorber 18 also has a high affinity for trapping sulfur and desulfation or de-$SO_x$, the process for the removal of stored sulfur from the $NO_x$ adsorber 18, also requires rich engine operation, but for a longer period of time and at much higher temperatures.

The DPF 20 may comprise one of several type of particle filters known and used in the art. The DPF 20 is utilized to capture unwanted diesel particulate matter ("DPM") from the flow of exhaust gas exiting the engine 12. DPM is sub-micron size particles found in diesel exhaust. DPM is composed of both solid and liquid particles and is generally classified into three fractions: (1) inorganic carbon (soot), (2) organic fraction (often referred to as SOF or VOF), and (3) sulfate fraction (hydrated sulfuric acid). The DPF 20 may be regenerated at regular intervals by combusting the particulates collected in the DPF 20 through exhaust manipulation or the like. Those skilled in the art would appreciate that, as it relates to the present invention, several different types of DPFs may be utilized in the present invention.

During engine operation, ambient air is inducted from the atmosphere and compressed by a compressor 22 of a turbocharger 23 before being supplied to the engine 12. The compressed air is supplied to the engine 12 through an intake manifold 24 that is connected with the engine 12. An air intake throttle valve 26 is positioned between the compressor 22 and the engine 12 that is operable to control the amount of charge air that reaches the engine 12 from the compressor 22. The air intake throttle valve 26 may be connected with, and controlled by, an electronic control unit ("ECU") 28, but may be controlled by other means as well. For the purpose of the present invention, it is important to note that the air intake throttle valve 26 is operable to control the amount of charge air entering the intake manifold 24 via the compressor 22.

An air intake sensor 30 is included either before or after the compressor 22 to monitor the amount of ambient air or charge air being supplied to the intake manifold 24. The air intake sensor 30 may be connected with the ECU 28 and generates electric signals indicative of the amount of charge air flow. An intake manifold pressure sensor 32 is connected with the intake manifold 24. The intake manifold pressure sensor 32 is operative to sense the amount of air pressure in the intake manifold 24, which is indicative of the amount of air flowing or provided to the engine 12. The intake manifold pressure sensor 32 is connected with the ECU 28 and generates electric signals indicative of the pressure value that are sent to the ECU 28.

The system 10 may also include a fuel injection system 34 that is connected with, and controlled by, the ECU 28. The purpose of the fuel injection system 30 is to deliver fuel into the cylinders of the engine 12, while precisely controlling the timing of the fuel injection, fuel atomization, the amount of fuel injected, as well as other parameters. Fuel is injected into the cylinders of the engine 12 through one or more fuel injectors 36 and is burned with charge air received from the intake manifold 24. Various types of fuel injection systems may be utilized in the present invention, including, but not limited to, pump-line-nozzle injection systems, unit injector and unit pump systems, common rail fuel injection systems and so forth.

Exhaust gases produced in each cylinder during combustion leaves the engine 12 through an exhaust manifold 38 connected with the engine 12. A portion of the exhaust gas is communicated to an exhaust gas recirculation ("EGR") system 40 and a portion of the exhaust gas is supplied to a turbine 42. The turbocharger 23 may be a variable geometry turbocharger 23, but other turbochargers may be utilized as well. The EGR system 34 is used to cool down the combustion process by providing a predetermined amount of exhaust gas to the charge air being supplied by the compressor 22. Cooling down the combustion process reduces the amount of $NO_x$ produced during the combustion process. An EGR cooler 41 may be included to further cool the exhaust gas before being supplied to the air intake manifold 22 in combination with the compressed air passing through the air intake throttle valve 26.

The EGR system 40 includes an EGR valve 44 this is positioned in fluid communication with the outlet of the exhaust manifold 38 and the air intake manifold 24. The EGR valve 44 may also be connected to the ECU 28, which is capable of selectively opening and closing the EGR valve 44. The EGR valve 44 may also have incorporated therewith a differential pressure sensor that is operable to sense a pressure change, or delta pressure, across the EGR valve 44. A pressure signal 46 may also be sent to the ECU 44 indicative of the change in pressure across the EGR valve 44. The air intake throttle valve 26 and the EGR system 40, in conjunction with the fuel injection system 34, may be controlled to run the engine 12 in either a rich or lean mode.

As set forth above, the portion of the exhaust gas not communicated to the EGR system 40 is communicated to the turbine 42, which rotates by expansion of gases flowing through the turbine 42. The turbine 42 is connected to the compressor 22 and provides the driving force for the compressor 22 that generates charge air supplied to the air intake manifold 24. Some temperature loss in the exhaust gas typically occurs as the exhaust gas passes through the turbine 42. As the exhaust gas leaves the turbine 42, it is directed to the exhaust filtration system 14, where it is treated before exiting the system 10.

A cooling system 48 may be connected with the engine 12. The cooling system 48 is a liquid cooling system that transfers waste heat out of the block and other internal components of the engine 12. Typically, the cooling system 48 consists of a closed loop similar to that of an automobile engine. Major components of the cooling system include a water pump, radiator or heat exchanger, water jacket (which consists of coolant passages in the block and heads), and a thermostat. As it relates to the present invention, the thermostat 50, which is the only component illustrated in FIG. 1, is connected with the ECU 28. The thermostat 50 is operable to generate a signal that is sent to the ECU 28 that indicates the temperature of the coolant used to cool the engine 12.

The system 10 includes a doser 52 that may be located in the exhaust manifold 38 and/or located downstream of the exhaust manifold 38. The doser 52 may comprise an injector mounted in an exhaust conduit 54. For the depicted embodiment, the agent introduced through the doser 52 is diesel fuel; however, other embodiments are contemplated in which one or more different dosing agents are used in addition to or in lieu of diesel fuel. Additionally, dosing could occur at a different location from that illustrated. For example, a fuel-rich setting could be provided by appropriate activation of injectors (not shown) that provide fuel to the engine in such a manner that engine 12 produces exhaust including a controlled amount of un-combusted (or incompletely combusted) fuel (in-cylinder dosing). Doser 52 is in fluid communication with a fuel line coupled to the same or a different fuel source (not shown) than that used to fuel engine 12 and is also connected with the ECU 28, which controls operation of the doser 52.

The system 10 also includes a number of sensors and sensing systems for providing the ECU 28 with information relating to the system 10. An engine speed sensor 56 may be included in or associated with the engine 12 and is connected with the ECU 28. The engine speed sensor 56 is operable to produce an engine speed signal indicative of engine rotation speed that is provided to the ECU 28. A pressure sensor 58 may be connected with the exhaust conduit 54 for measuring the pressure of the exhaust before it enters the exhaust filtration system 14. The pressure sensor 58 may be connected with the ECU 28. If pressure becomes too high, this may indicate that a problem exists with the exhaust filtration system 14, which may be communicated to the ECU 28.

At least one temperature sensor 60 may be connected with the DOC unit 16 for measuring the temperature of the exhaust gas as it enters the DOC unit 16. In other embodiments, two temperature sensors 60 may be used, one at the entrance or upstream from the DOC unit 16 and another at the exit or downstream from the DOC unit 60. These temperature sensors are used to calculate the temperature of the DOC unit 16. In this alternative, an average temperature may be determined, using an algorithm, from the two respective temperature readings of the temperature sensors 60 to arrive at an operating temperature of the DOC unit 60.

Figure 2:
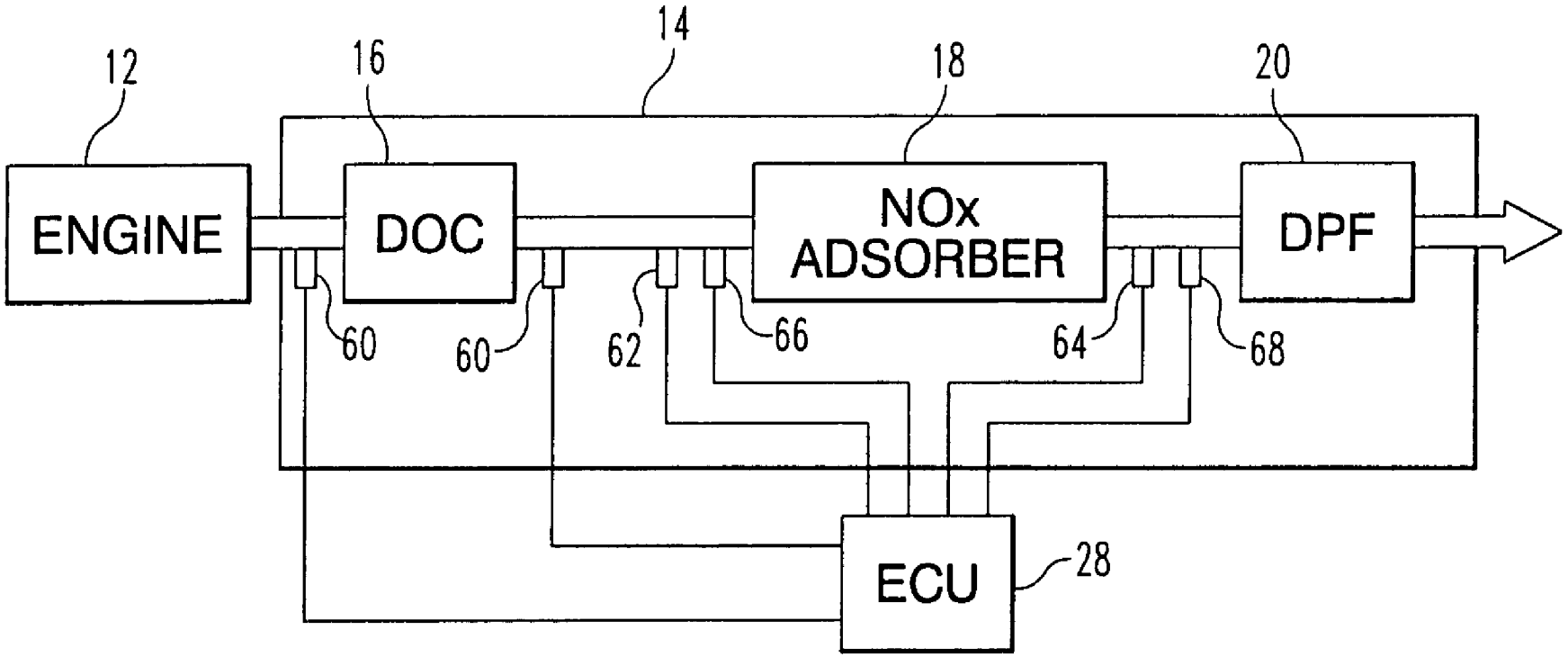
FIG. 2 is a more detailed schematic of the exhaust system of the representative diesel engine system.

Referring to FIG. 2, a more detailed diagram of the exhaust filtration system 14 is depicted connected in fluid communication with the flow of exhaust leaving the engine 12. A first $NO_x$ temperature sensor 62 may be in fluid communication with the flow of exhaust gas before entering or upstream of the $NO_x$ adsorber 18 and is connected to the ECU 28. A second $NO_x$ temperature sensor 64 may be in fluid communication with the flow of exhaust gas exiting or downstream of the $NO_x$ adsorber 18 and is also connected to the ECU 28. The $NO_x$ temperature sensors 62, 64 are used to monitor the temperature of the flow of gas entering and exiting the $NO_x$ adsorber 18 and provide electric signals that are indicative of the temperature of the flow of exhaust gas to the ECU 28. An algorithm may then be used by the ECU 28 to determine the operating temperature of the $NO_x$ adsorber 18.

A first universal exhaust gas oxygen ("UEGO") sensor or lambda sensor 66 may be positioned in fluid communication with the flow of exhaust gas entering or upstream from the $NO_x$ adsorber 18 and a second UEGO sensor 68 may be positioned in fluid communication with the flow of exhaust gas exiting or downstream of the $NO_x$ adsorber 18. The UEGO sensors 66, 68 are connected with the ECU 28 and generate electric signals that are indicative of the amount of oxygen contained in the flow of exhaust gas. The UEGO sensors 66, 68 allow the ECU 28 to accurately monitor air-fuel ratios ("AFR") also over a wide range thereby allowing the ECU 28 to determine a lambda value associated with the exhaust gas entering and exiting the $NO_x$ adsorber 18. In alternative embodiments, sensors 66, 68 may comprise $NO_x$ sensors utilized to monitor $NO_x$ values entering and exiting the $NO_x$ adsorber 18.

Figure 3:
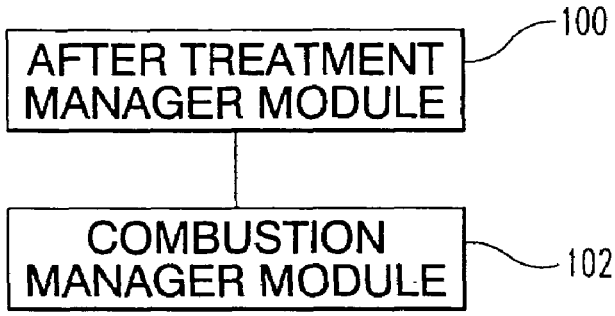
FIG. 3 illustrates representative control modules of the system.

Referring to FIG. 3, the system 10 includes an after-treatment manager module or software routine 100 and a combustion manager module or software routine 102 that are executable by the ECU 28. The after-treatment manager module 100 is operable to generate control signals that are sent to the combustion manager module 102 during regeneration or de-$SO_x$ of the DOC unit 16, the DPF 20 and the $NO_x$ adsorber 18 (de-$NO_x$ and/or de-$SO_x$). The combustion manager module 102 consists of computer executable code that is operable to set target values to manage the combustion process of the engine 12. Depending on the operating condition of the engine 12, for example, idle operation or under various driving conditions, the combustion manager module 102 may control output values for, amongst other parameters, the amount of charge air flow and EGR flow that is permitted to enter the air intake manifold 26, the amount of fuel provided and the timing of the injection, fuel atomization, and so forth. For purposes of the present invention, it is important to note that the combustion manager module 102 is operable to control the engine 12 to operate in either a lean or rich mode.

Figure 4:
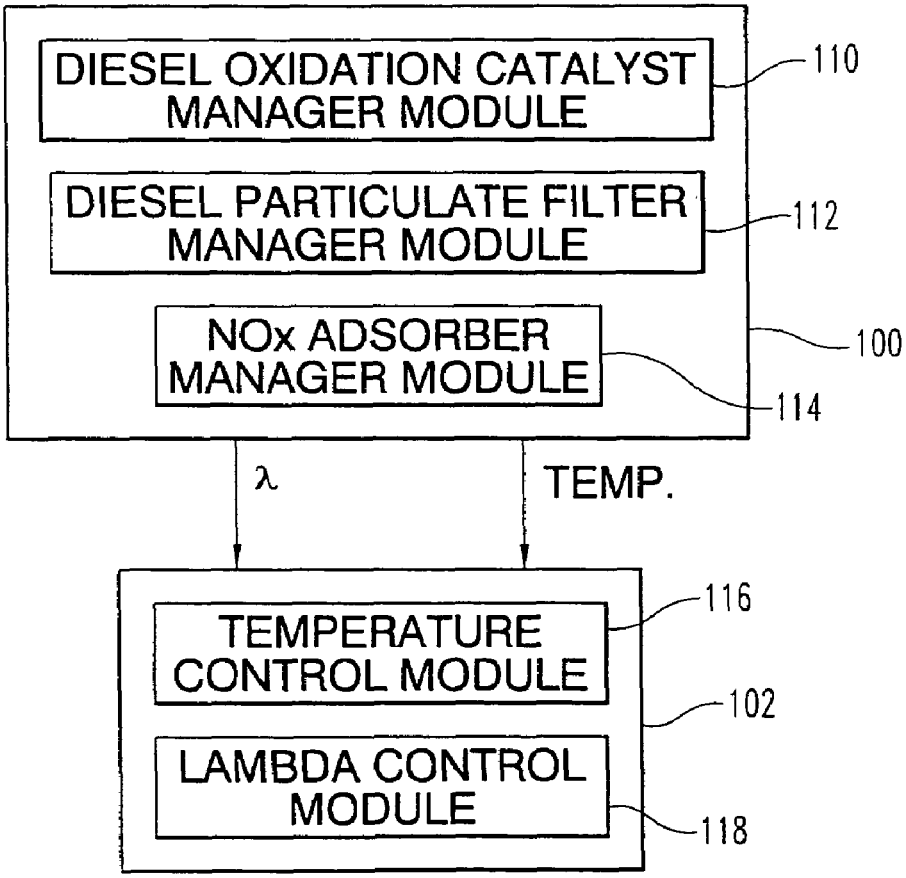
FIG. 4 is a detailed illustration of the control modules set forth in FIG. 3.

Referring to FIG. 4, the after-treatment manager module includes a DOC manager module 110, a DPF manager module 112, and a $NO_x$ adsorber manager module 114. The DOC manager module 110 is responsible for generating commands and storing an engine operating profile that is used by the combustion manager module 102 when the DOC unit 16 needs to be regenerated. The DPF manager module 112 is responsible for generating commands and storing an engine operating profile that is used by the combustion manager module 102 when the DPF 18 needs regenerated. As it relates to the present invention, the $NO_x$ adsorber manager module 114 is responsible for generating commands and containing an engine operating profile, for both de-$NO_x$ and de-$SO_x$ modes, that is used by to the combustion manager module 102 when the $NO_x$ adsorber 18 needs to run in either a de-$NO_x$ or de-$SO_x$ mode.

As set forth above, the combustion manager module 102 controls the combustion process of the engine 12 using various engine operating parameters known in the art. The combustion manager module 102 includes at least a temperature control module 116 and a lambda ("λ") control module 118. The temperature control module 116 is executable by the ECU 28 to control the operating temperature of the engine 12, which in turn, controls the temperature of the flow of exhaust leaving the engine 12. The lambda control module 118 is executable by the ECU 28 to control the engine 12 to run at various air-to-fuel ratios (otherwise referred to as lambda values). The manner in which the temperature of the engine 12 is controlled is well known in the art and may be accomplished using various parameters.

The lambda control module 118 generates commands that are sent by the ECU 28 to the fuel system 34, the air intake throttle valve 26, the EGR system 40, and several other components. The commands are operable to cause the engine 12 to run or operate in either a lean mode (lambda>1) where there is an excess of oxygen in relation to the amount of fuel in the air-fuel mixture or a rich mode (lambda<1) where there is an excess of fuel in relation to the amount of oxygen in the air-fuel mixture. In lean mode, the proportion of environmentally harmful exhaust gas components formed, such as CO and HC for example, is relatively small and thanks to the excess oxygen, they can be readily converted by the exhaust system 14 into other compounds that are environmentally less relevant. However, as previously set forth, large amounts of $NO_x$ are formed while operating in lean mode that cannot completely be reduced and are thus stored in the $NO_x$ adsorber 18 until they can be converted and released during a de-$NO_x$ process.

As set forth above, the $NO_x$ adsorber 18 needs to be regenerated at regular intervals once a predetermined threshold amount of $NO_x$ has been absorbed by the $NO_x$ adsorber 18. In addition, de-$SO_x$ of the $NO_x$ adsorber 18 must also occur at regular intervals once a predetermined threshold amount of SOX has absorbed to the $NO_x$ adsorber 18. The de-$NO_x$ process occurs much more frequently than a de-$SO_x$ process. In addition, the ECU 28 typically only runs the engine 12 in de-$NO_x$ mode for a relatively short period of time (e.g. ~30 seconds) as opposed to the de-$SO_x$ mode, which takes much longer (e.g. ~30 minutes). For illustrative purposes only, the $NO_x$ adsorber manager module 114 may only generate a regeneration request every three minutes that runs for approximately 30 seconds whereas a de-$SO_x$ request may be generated once every three weeks and run for approximately 30 minutes.

Figure 5:
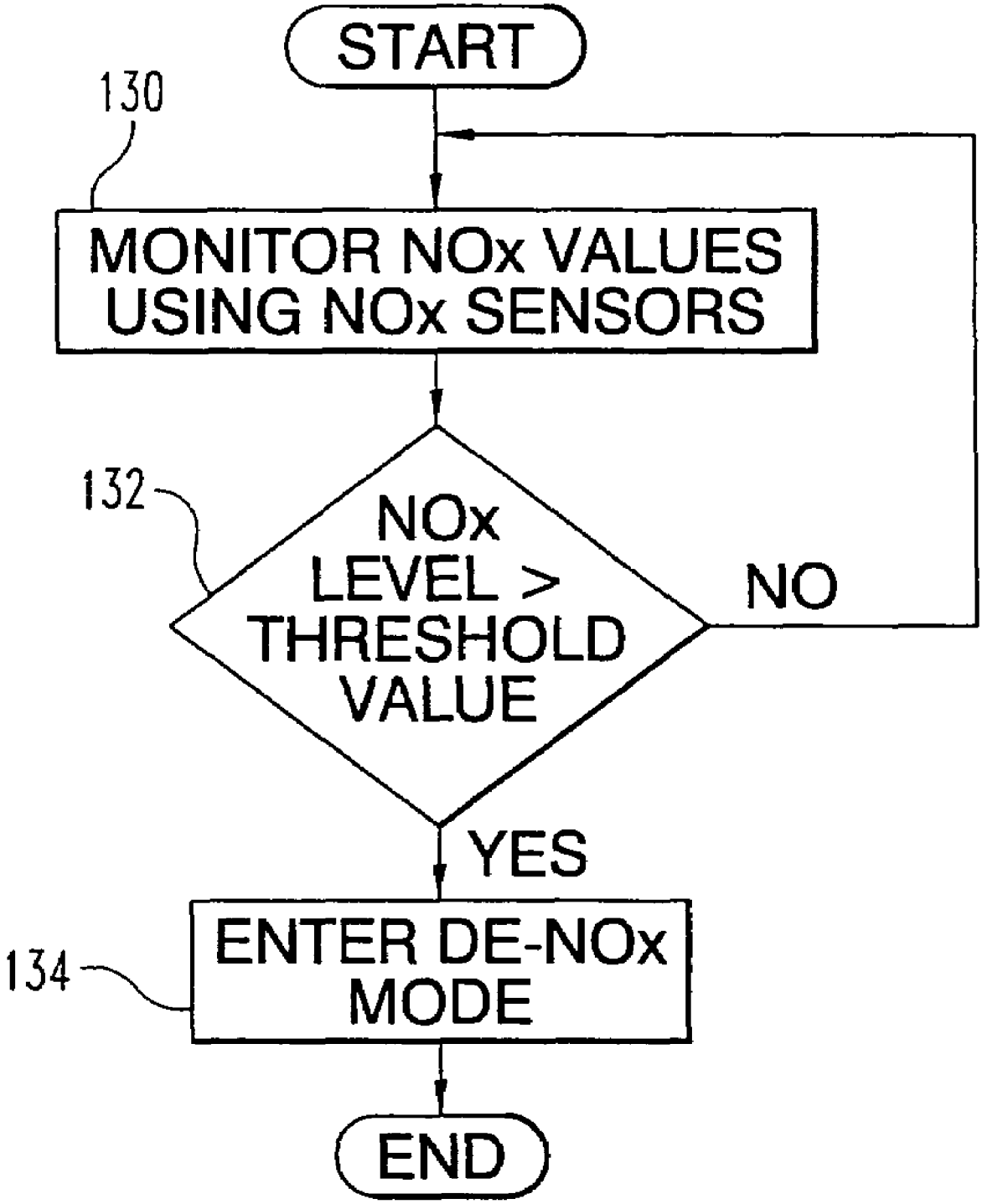
FIG. 5 is a flow chart illustrating process steps performed by the $NO_x$ adsorber manager module relating to de-$NO_x$ operation.

Referring to FIG. 5, in order to determine when to enter de-$NO_x$ mode, the $NO_x$ adsorber manager module 114 may monitor various parameters. In one embodiment, the need to enter de-$NO_x$ mode may be triggered by a decreasing storage capacity in the $NO_x$ adsorber 18, which is illustrated at step 130. The $NO_x$ sensors 66, 68 may be utilized to detect a decreasing $NO_x$ storage capacity of the $NO_x$ adsorber 18 by monitoring the amount of $NO_x$ entering the $NO_x$ adsorber 18 and comparing it with the amount of $NO_x$ leaving the $NO_x$ adsorber 18. Once a predetermined threshold value of $NO_x$ is sensed as leaving the $NO_x$ adsorber 18 as compared to the amount being introduced (step 132), the $NO_x$ adsorber manager module 114 may generate a regeneration request or flag that causes the combustion manager module 102 to enter de-$NO_x$ mode (step 134).

In yet another embodiment, a regeneration request may be generated by the $NO_x$ adsorber manager module 114 as a function of various parameters. The regeneration request may be timing based and/or fueling based. As such, the regeneration request may be determined as a function of the amount of fuel the engine 12 has utilized and/or the amount of time the engine 12 has been running and/or the estimated amount of $NO_x$ discharged from the engine 12. Once thresholds are reached, the regeneration request or flag is set. In addition, the regeneration request may also be dependent upon the amount of $NO_x$ trapped by the $NO_x$ adsorber 18 as well as the storage capacity of the $NO_x$ adsorber 18. This value may be obtained by monitoring the UEGO sensors 66, 68 (i.e.—input $NO_x$ vs. output $NO_x$. Once a predetermined amount of $NO_x$ is determined as being trapped, a regeneration request is generated or a regeneration flag is set. Further, the regeneration request or flag may also be determined as a function of the measured or experimentally determined $NO_x$ trapping efficiency.

Figure 6:
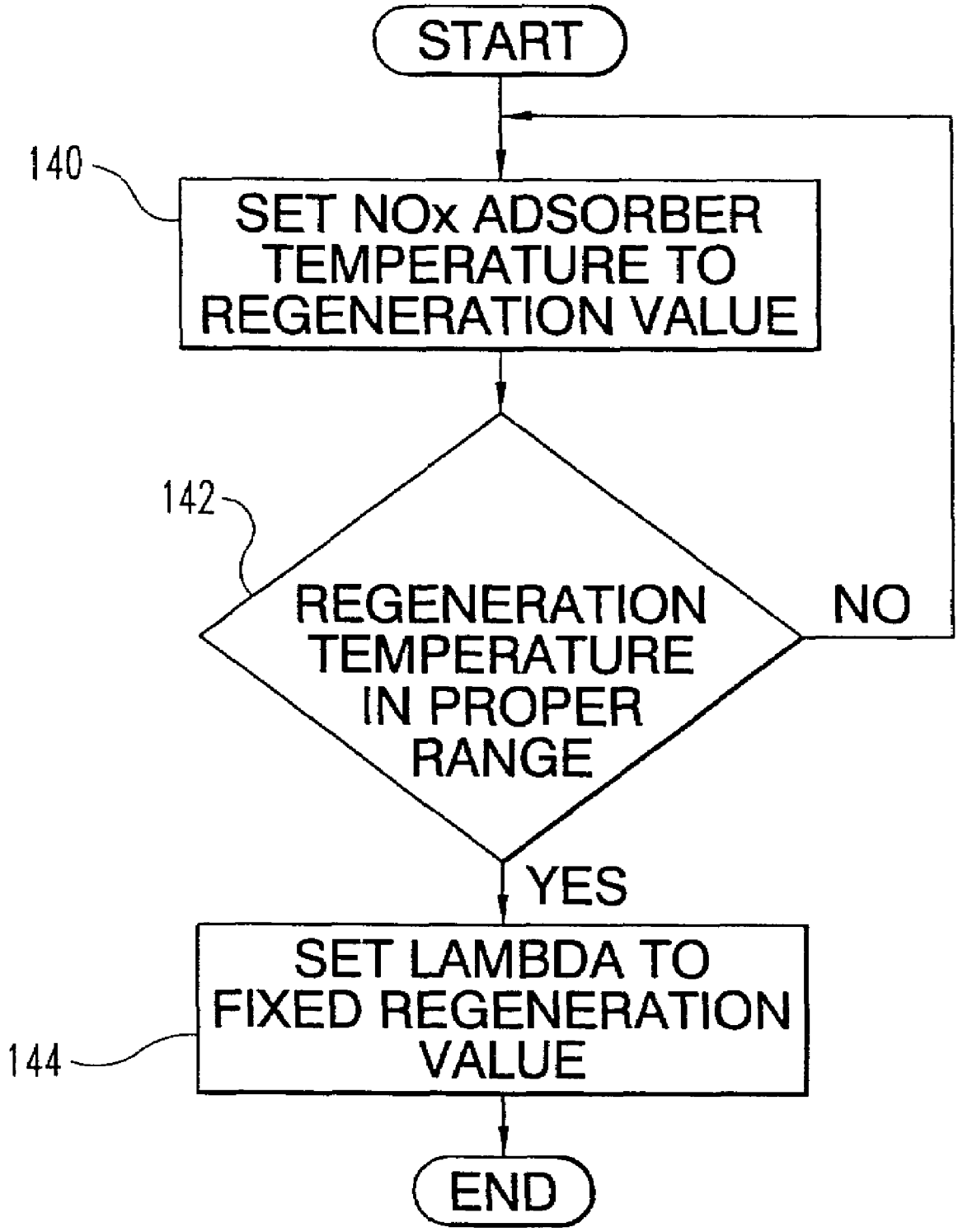
FIG. 6 is a flow chart illustrating process steps performed by the combustion manager module relating to de-$NO_x$ operation.

Referring to FIG. 6, when entering into de-$NO_x$ mode, the combustion manager module 102 controls the temperature of the $NO_x$ adsorber 18 (through control of the engine 12) as well as the lambda value of the engine 12. The respective settings for the temperature value and the lambda value may be communicated to or obtained by the combustion manager module 102 by or from the after-treatment manager module 100 (see FIG. 4). The $NO_x$ adsorber manager module 114 contains a $NO_x$ lambda profile that may be used by the combustion manager module 102 At step 140, the temperature control module 116 sets the operating temperature of the $NO_x$ adsorber 18 to a proper regeneration temperature value, which typically lies somewhere between approximately 200-450° C. The temperature control module 116 may increase the temperature of the $NO_x$ adsorber 18 by adjusting various well known engine parameters (fueling, dosing, charge air, and so forth), which is beyond the scope of the present invention.

At step 142, the $NO_x$ temperature sensors 62, 64 may be used by the ECU 28 to determine when the $NO_x$ adsorber 18 reaches a proper regeneration temperature range/value. Once the $NO_x$ adsorber 18 reaches a proper temperature value to perform the de-$NO_x$ process, the lambda control module 118 may set the engine to a fixed or constant regeneration lambda value obtained from the $NO_x$ lambda profile. In one embodiment, the fixed regeneration lambda value lies between 0.85-0.95. In de-$NO_x$ mode, the engine 12 is caused to operate in a rich mode having a fixed regeneration lambda value, which is illustrated at step 144. The engine 12 may then run in de-$NO_x$ mode for a predetermined period of time at the fixed lambda value, the time period varying from application to application.

Figure 7:
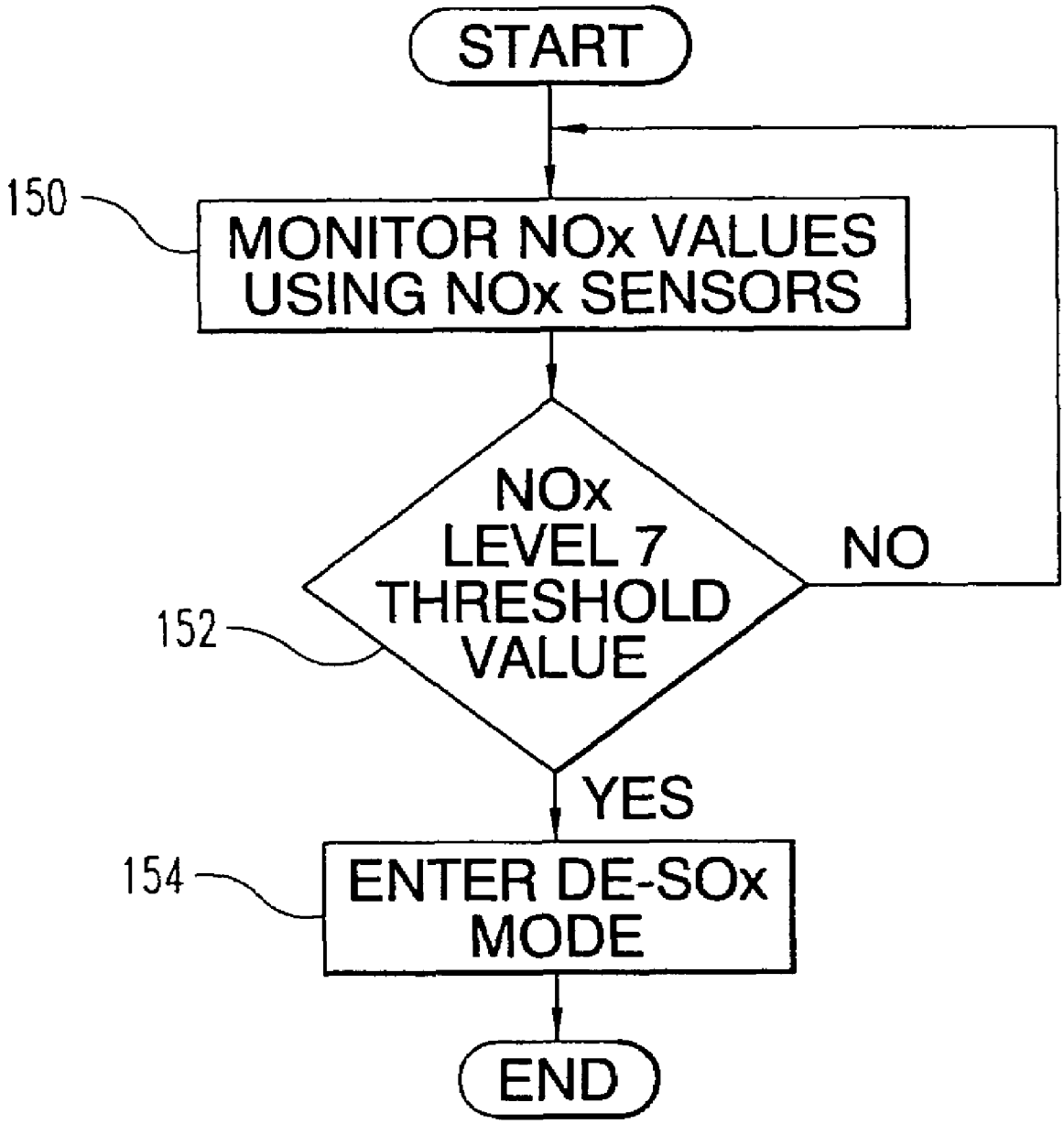
FIG. 7 is a flow chart illustrating process steps performed by the $NO_x$ adsorber manager module relating to de-$SO_x$ operation.

Referring to FIG. 7, the need for de-$SO_x$ or for the engine 12 to operate in de-$SO_x$ mode may be determined by the $NO_x$ adsorber manager module 114 using various parameters as well. In one embodiment, the need to enter de-$SO_x$ mode may be triggered by readings obtained from the $NO_x$ sensors 66, 68, which is illustrated at step 150. The $NO_x$ sensors 66, 68 may be utilized to detect a decreasing $NO_x$ storage capacity of the $NO_x$ adsorber 18 by monitoring the amount of $NO_x$ entering the $NO_x$ adsorber 18 as compared to the amount of $NO_x$ leaving the $NO_x$ adsorber 18. Once a predetermined threshold value of $NO_x$ is sensed as leaving the $NO_x$ adsorber 18 (step 152), the $NO_x$ adsorber manager module 114 may generate a de-$SO_x$ request that is utilized by the combustion manager module 102 to enter de-$SO_x$ mode (step 154).

In yet another embodiment, a de-$SO_x$ request may be generated by the $NO_x$ adsorber manager module 114 as a function of various parameters. The regeneration request may be timing/mileage based and/or fueling based. As such, the de-$SO_x$ request may be determined as a function of the amount of fuel the engine 12 has utilized, the amount of time the engine 12 has been running and/or the distance traveled. In addition, the regeneration request may also be dependent upon the amount of $SO_x$ trapped by the $NO_x$ adsorber 18 as well as the storage capacity of the $NO_x$ adsorber 18 in relation to the values set forth above. This value may be obtained by monitoring the $NO_x$ sensors 66, 68 (i.e.—input $NO_x$ vs. output $NO_x$. Once a predetermined amount of $SO_x$ is determined as being trapped, a de-$SO_x$ request is generated or a flag is set to notify the combustion manager module 102. Further, the de-$SO_x$ request may also be determined as a function of the measured or experimentally determined $NO_x$ trapping efficiency.

Figure 8:
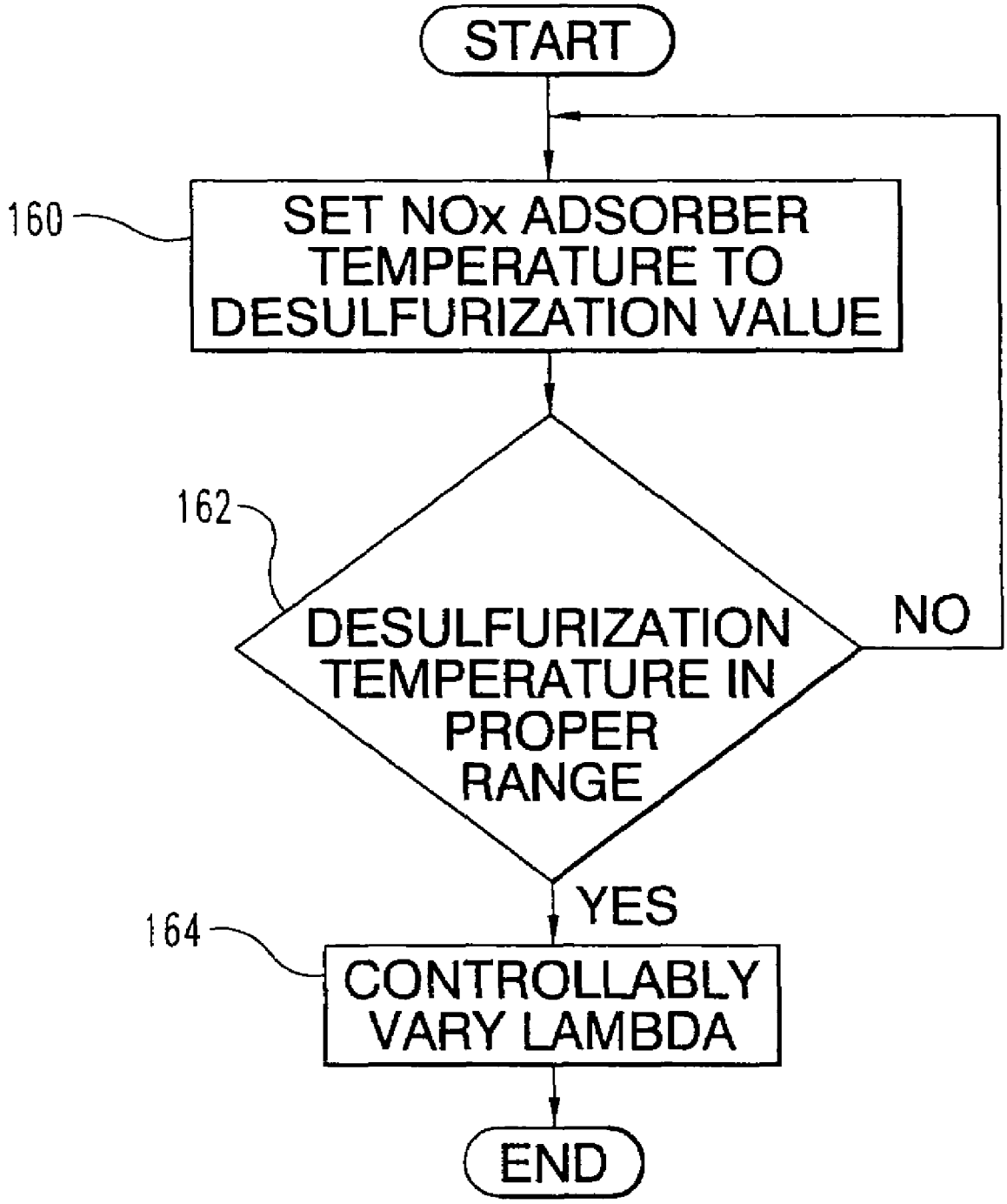
FIG. 8 is a flow chart illustrating process steps performed by the combustion manager module relating to de-$SO_x$ operation.

Referring to FIG. 8, when entering into de-$SO_x$ mode, the combustion manager module 102 controls the temperature of the $NO_x$ adsorber 18 as well as the lambda value of the engine 12 through control of the combustion process. The respective settings for the temperature value and the lambda value may be communicated to or obtained by the combustion manager module 102 from the $NO_x$ adsorber manager module 114 (see FIG. 4). At step 160, the temperature control module 116 sets the operating temperature of the $NO_x$ adsorber 18 to a proper regeneration value, which is typically equal to or greater than about 600° C. The temperature control module 116 may increase the temperature of the $NO_x$ adsorber 18 by adjusting various well known engine parameters (fueling, dosing, charge air, and so forth), which is beyond the scope of the present invention.

At step 162, the $NO_x$ temperature sensors 62, 64 may be used by the ECU 28 to determine when the $NO_x$ adsorber 18 reaches a proper de-$SO_x$ temperature range/value. Once the $NO_x$ adsorber 18 reaches a proper temperature value to perform the de-$SO_x$ process, the lambda control module 118 may set the engine 12 to function at a controllably variable lambda value. The controllably variable lambda values may be contained in a $SO_x$ lambda profile of the $NO_x$ adsorber manager module 114 In one embodiment, the lambda value is varied between 0.9-1.1 (see FIG. 9). The combustion manager module 102 controls the engine 12 to operate in a rich mode for a predetermined period of time and a lean mode for a predetermined period of time, which is illustrated at step 164. The engine 12 may then run in this de-$SO_x$ mode for a predetermined period of time at the varying lambda value, the predetermined period of time varying from application to application.

Figure 9:
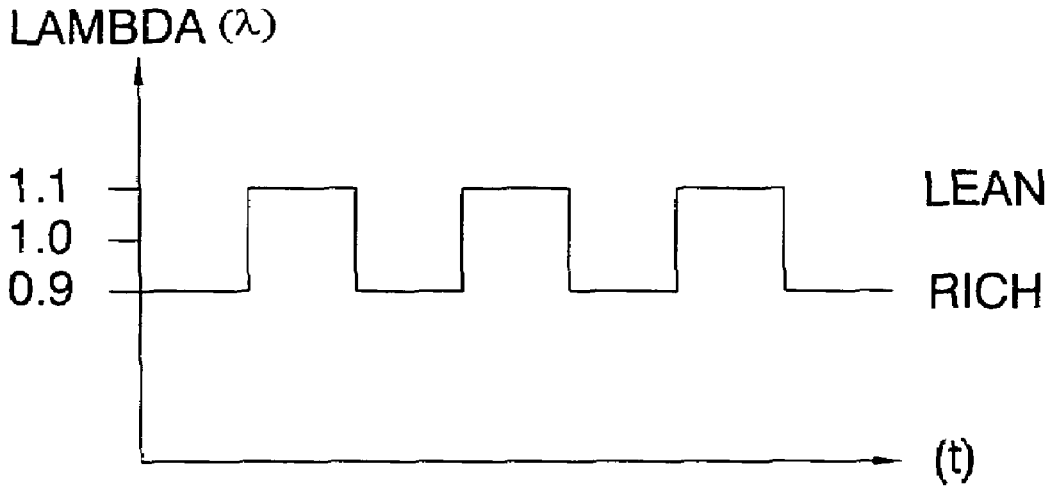
FIG. 9 represents how lambda is controllably varied during de-$SO_x$ operation.

As illustrated in FIG. 9, the lambda control module 118 of the combustion manager module 102 may vary the lambda value of the engine 12 between an upper set point value (lean mode) and a lower set point value (rich mode). The lambda control module 114 may receive the set point values from the $NO_x$ adsorber manager module 114, which may represent calibrated values contained in the $SO_x$ lambda profile. The duty cycle of varying the lambda values may vary (e.g. –50%) from application to application. As such, the amount of time spent at the upper set point value and lower set point value may vary based on engine design. Although a square wave duty cycle is illustrated in FIG. 9, other duty cycle waveforms may be utilized as well (e.g.—sine, saw tooth, and so forth). The combustion manager module 102 controls the engine 12 to achieve the target lambda values. As such, the de-$SO_x$ mode variably causes the engine 12 to supply the $NO_x$ adsorber 18 with both rich exhaust gas and lean exhaust gas for predetermined amounts of time.

Figure 10:
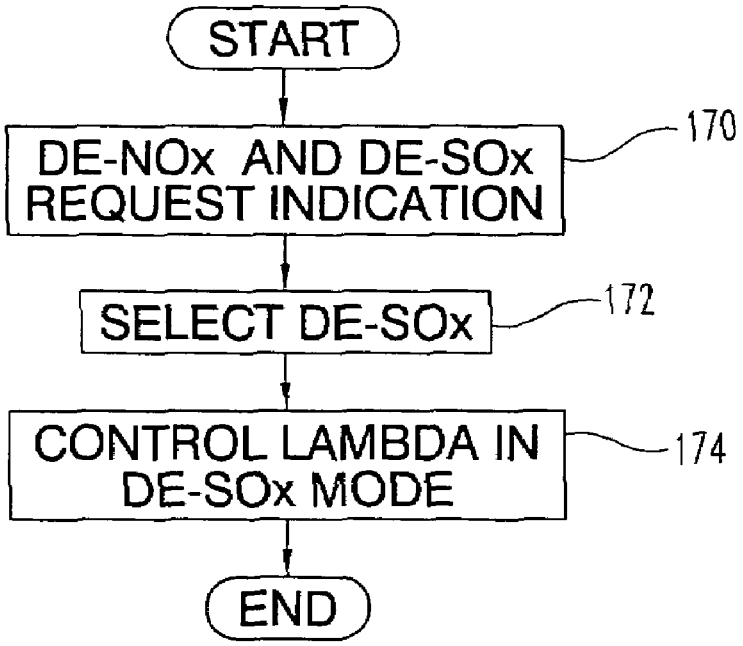
FIG. 10 is a flow chart illustrating the prioritization of de-$SO_x$ operation over de-$NO_x$ operation.

Referring to FIG. 10, another aspect of the present invention relates to prioritizing whether to run in de-$NO_x$ or de-$SO_x$ mode when a need exists to perform both functions. At step 170, the $NO_x$ adsorber manager module 114 may determine that the $NO_x$ adsorber 18 needs to perform both a de-$NO_x$ and de-$SO_x$. If the $NO_x$ adsorber manager module 114 determines the need for a de-$NO_x$ and de-$SO_x$ mode at the same time, at step 172, the $NO_x$ adsorber manager module 114 selects to enter the de-$SO_x$ mode and ignores the de-$NO_x$ request or indication until after the de-$SO_x$ process is complete. At step 174, the combustion manager module 102 controls the engine 12 in de-$SO_x$ mode using the $SO_x$ lambda profile, as previously set forth.

In the preferred embodiment, the UEGO sensor 66 positioned upstream of the $NO_x$ adsorber 18 is used to obtain a lambda reading that is used by the combustion manager module 102 to control the engine 12 to achieve the respective lambda settings during de-$NO_x$ and de-$SO_x$. In one illustrative embodiment, a feed forward and PI feedback control architecture of the type described in U.S. Pat. No. 6,467,469 to Yang et al. is used to control lambda. Alternatively, other known control techniques may be used to achieve the desired lambda profile. As such, the de-$NO_x$ lambda profile causes the engine 12 to operate at a fixed lambda value and the de-$SO_x$ lambda profile causes the engine to operate (via the combustion manager module 102) at controllably variable lambda values.

As set forth above, one aspect of the present invention discloses a system comprising an electronic control unit 28 connected with an engine 12 for selectively controlling operation of the engine 12 between a rich operating mode and a lean operating mode, a $NO_x$ adsorber 18 in fluid communication with a flow of exhaust from the engine 12, a lambda sensor 66 positioned in fluid communication with the flow of exhaust and the $NO_x$ adsorber 18 and connected to the electronic control unit 28, wherein the lambda sensor 66 is operable to generate a lambda signal indicative of a lambda value associated with the flow of exhaust entering the $NO_x$ adsorber 18, a $NO_x$ adsorber manager module 114 executable by the electronic control unit 28, wherein the $NO_x$ adsorber manager module 114 is operative to determine the need to operate in a de-$NO_x$ mode or a de-$SO_x$ mode, wherein the $NO_x$ adsorber manager module 114 includes a $NO_x$ lambda profile associated with the de-$NO_x$ mode and a $SO_x$ lambda profile associated with the de-$SO_x$ mode, and wherein if the $NO_x$ adsorber manager module 114 determines a need exists to operate in the de-$NO_x$ mode and the de-$SO_x$ mode at the same time the $NO_x$ adsorber manager module 114 executes the de-$SO_x$ mode.

Another aspect of the present invention discloses a method comprising the steps of receiving an indication that an engine 12 needs to operate in a de-$NO_x$ mode to de-$NO_x$ a $NO_x$ adsorber 18 and receiving a second indication that the engine 12 needs to operate in a de-$SO_x$ mode to de-$SO_x$ the $NO_x$ adsorber 18 at approximately a same point in time, selecting to operate in the de-$SO_x$ mode, obtaining a de-$SO_x$ lambda profile associated with operating in the de-$SO_x$ mode, and controlling operation of the engine 12 using the de-$SO_x$ lambda profile.

Another aspect discloses an electronic control unit product for use with a $NO_x$ adsorber 18 that removes unwanted material from a flow of exhaust generated by an engine 12. The electronic control unit product comprises an electronic control unit usable medium having computer readable program code embodied in the medium for controlling de-$NO_x$ and de-$SO_x$ of the $NO_x$ adsorber 18, the electronic control unit product having: computer readable program code operable to simultaneously receive a de-$NO_x$ request and a de-$SO_x$ request associated with the $NO_x$ adsorber 18, computer readable program code for prioritizing the de-$NO_x$ request and the de-$SO_x$ request by selection of the de-$SO_x$ request, computer readable program code for obtaining a de-$SO_x$ lambda profile, and computer readable program code for controlling operation of the engine 12 utilizing the de-$SO_x$ lambda profile.

Yet another aspect discloses a system comprising an electronic control unit 28 connected with an engine 12 for selectively controlling operation of the engine 12 between a rich operating mode and a lean operating mode, a $NO_x$ adsorber 18 in fluid communication with a flow of exhaust from the engine 12, means for prioritizing a de-$SO_x$ request before a de-$NO_x$ request if the de-$SO_x$ request and the de-$NO_x$ request are received at approximately a same point in time, means for raising an operating temperature value associated with the $NO_x$ adsorber 18 to a de-$SO_x$ temperature value, means for obtaining a lambda value associated with the flow of exhaust entering the $NO_x$ adsorber 18, and means for controlling the engine 12 such that the lambda value controllably switches between an upper lambda limit and a lower lambda limit for a predetermined period of time.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A system, comprising:

an electronic control unit connected with an engine for selectively controlling operation of the engine between a rich operating mode and a lean operating mode;

a $NO_x$ adsorber in fluid communication with a flow of exhaust from the engine;

a lambda sensor positioned in fluid communication with the flow of exhaust and the $NO_x$ adsorber and connected to the electronic control unit, wherein the lambda sensor is operable to generate a lambda signal indicative of a lambda value associated with the flow of exhaust entering the $NO_x$ adsorber;

a $NO_x$ adsorber manager module executable by the electronic control unit, wherein the $NO_x$ adsorber manager module is operative to determine the need to operate in a de-$NO_x$ mode or a de-$SO_x$ mode, wherein the $NO_x$ adsorber manager module includes a $NO_x$ lambda profile associated with the de-$NO_x$ mode and a $SO_x$ lambda profile associated with the de-$SO_x$ mode, wherein if the $NO_x$ adsorber manager module determines a need exists to operate in the de-$NO_x$ mode and the de-$SO_x$ mode at the same time the $NO_x$ adsorber manager module executes the de-$SO_x$ mode if it is feasible given current engine operating conditions, wherein the $NO_x$ lambda profile causes the engine to operate at a fixed lambda value and the $SO_x$ lambda profile causes the engine to operate at a controllably varying lambda value, and wherein the controllably varying lambda value controllably switches between an upper set point controlling the engine in a lean operating mode for a first predetermined amount of time and a lower set point controlling the engine in a rich operating mode for a second predetermined amount of time.

2. The system of claim 1, further comprising a combustion manager module for controlling operation of the engine using the $SO_x$ lambda profile while operating in the de-$SO_x$ mode.

3. The system of claim 2, wherein the upper set point is a lambda value of approximately 0.9 and the upper set point is a lambda value of approximately 1.1.

4. The system of claim 1, wherein if the $NO_x$ adsorber manager module determines a need does not exist to operate in the de-$SO_x$ mode but a need exists to operate in the de-$NO_x$ mode a combustion manager module controls the engine to function in the de-$NO_x$ mode using the $NO_x$ lambda profile.

5. The system of claim 4, wherein the $NO_x$ lambda profile causes the combustion manager module to maintain the engine at a fixed lambda value.

6. A method, comprising:

receiving an indication that an engine needs to operate in a de-$NO_x$ mode to de-$NO_x$ a $NO_x$ adsorber and receiving a second indication that the engine needs to operate in a de-$SO_x$ mode to de-$SO_x$ the $NO_x$ adsorber at approximately a same point in time;

selecting to operate in the de-$SO_x$ mode if the engine is currently capable of doing so;

selecting to operate in the de-$NO_x$ mode if the engine is not capable of operating in the de-$SO_x$ mode;

obtaining a de-$SO_x$ lambda profile associated with operating in the de-$SO_x$ mode; and controlling operation of the engine using the de-$SO_x$ lambda profile, wherein the de-$SO_x$ lambda profile controllably varies a lambda value associated with the engine between an upper set point value and a lower set point value, wherein a first duty cycle associated with operating the engine at the upper set point value is a first calibrated value and a second duty cycle associated with operating the engine at the lower set point value is a second calibrated value.

7. The method of claim 6, wherein the de-$SO_x$ lambda profile controllably switches operation of the engine between a rich operating mode and a lean operating mode for a predetermined period of time as a function of the first and second duty cycles.

8. The method of claim 6, further comprising the step of operating in the de-$NO_x$ mode if the need to operate in the de-$SO_x$ mode does not exist.

9. The method of claim 8, further comprising the step of selecting a de-$NO_x$ lambda profile.

10. The method of claim 9, further comprising the step of controlling operation of the engine using the de-$NO_x$ lambda profile.

11. The method of claim 10, wherein the de-$NO_x$ lambda profile causes the engine to be controlled at a fixed lambda value for a predetermined period of time.

12. The method of claim 6, wherein in the de-$NO_x$ mode the engine operates at a fixed lambda value.

13. The method of claim 12, wherein the controllably varied lambda values comprise a lean operating lambda value and a rich operating lambda value.

14. An electronic control unit product for use with a $NO_x$ adsorber that removes unwanted material from a flow of exhaust generated by an engine, comprising:

an electronic control unit having computer readable program code embodied therein for controlling de-$NO_x$ and de-$SO_x$ of the $NO_x$ adsorber, the electronic control unit having:

computer readable program code operable to receive a de-$NO_x$ request and a de-$SO_x$ request associated with the $NO_x$ adsorber at approximately a same point in time;

computer readable program code for prioritizing the de-$NO_x$ request and the de-$SO_x$ request by selection of the de-$SO_x$ request;

computer readable program code for obtaining a de-$SO_x$ lambda profile in response to the de-$SO_x$ request, wherein the de-$SO_x$ lambda profile includes an upper lambda set point value and a lower lambda set point value; and computer readable program code for controlling operation of the engine with the de-$SO_x$ lambda profile, wherein the engine is controllably operated to switch between the upper lambda set point value and the lower lambda set point value at predetermined time intervals.

15. The electronic control unit product of claim 14, wherein the upper lambda set point value causes the engine to operate in a lean mode and the lower lambda set point value causes the engine to operate in a rich mode.

16. A system, comprising:

an electronic control unit connected with an engine for selectively controlling operation of the engine between a rich operating mode and a lean operating mode;

a $NO_x$ adsorber in fluid communication with a flow of exhaust from the engine;

means for prioritizing a de-$SO_x$ request before a de-$NO_x$ request if the de-$SO_x$ request and the de-$NO_x$ request are received at approximately a same point in time;

a combustion manager for raising an operating temperature value associated with the $NO_x$ adsorber to a de-$SO_x$ temperature value while processing the de-$SO_x$ request;

a sensor for obtaining a lambda value associated with the flow of exhaust entering the $NO_x$ adsorber; and where the engine is controlled while processing the de-$SO_x$ request such that the lambda value controllably varies between an upper lambda limit for a first predetermined period of time and a lower lambda limit for a second predetermined period of time.

17. The system of claim 16, wherein the upper lambda limit causes the engine to operate in a lean mode and the lower lambda limit causes the engine to operate in a rich mode.

* * * * *